US006199386B1

(12) United States Patent
Garrett et al.

(10) Patent No.: US 6,199,386 B1
(45) Date of Patent: Mar. 13, 2001

(54) SPIRIT CHILLER

(75) Inventors: Michael Ernest Garrett, Woking; Evelyn Arthur Shervington, East Harting Petersfield, both of (GB)

(73) Assignee: The BOC Group plc, Windlesham (GB)

( * ) Notice: Subject to any disclaimer, the term of this patent is extended or adjusted under 35 U.S.C. 154(b) by 0 days.

(21) Appl. No.: 09/283,892

(22) Filed: Apr. 1, 1999

(30) Foreign Application Priority Data

Apr. 8, 1998 (GB) ..... 9807594

(51) Int. Cl.[7] ..... F25B 19/00; B67D 5/62; F25D 3/10

(52) U.S. Cl. ..... 62/51.1; 62/397; 62/529

(58) Field of Search ..... 62/396, 397–400, 62/51.1, 530, 529

(56) References Cited

U.S. PATENT DOCUMENTS 1,591,623 * 7/1926 Hassensall ..... 62/397
2,313,954 * 3/1943 Mariani ..... 62/397
4,407,356 * 10/1983 DeLau ..... 165/132
4,599,872 * 7/1986 Rist ..... 62/399
5,009,083 * 4/1991 Spinos et al. ..... 62/400
5,142,874 * 9/1992 Maric ..... 62/49.2
5,427,276 * 6/1995 Knuettel et al. ..... 222/131
5,799,506 * 9/1998 Johansson et al. ..... 62/616

* cited by examiner

*Primary Examiner*—William Doerrler
(74) *Attorney, Agent, or Firm*—Philip N. Von Neida; Salvatore P. Pace

(57) ABSTRACT

A spirit chilling apparatus comprising a drink chilling tube (4) concentric within an insulated container (6) filled with a constant boiling cryogen (8), such as acetone and solid carbon dioxide or similar azeotropic mixture. The innertube (4) is held in relatively poor thermal contact with the vessel (6) containing the liquid so that over a period of time it will adopt the temperature of the liquid (8) but when a measure of spirit is poured through it the specific heat of the tube (4) will be sufficient to result in a net temperature of −5° C. for both the spirit and the tube (4), the heat flow from the surrounding vessel (6) being insufficient to materially affect this. If the tube (4) is left in place it will again cool to the previous temperature so that a further measure of spirit can be cooled.

14 Claims, 4 Drawing Sheets

SPIRIT CHILLER

This invention relates to the supply of a liquid, particularly but not exclusively a potable liquid such as a spirit drink, which has been chilled below ambient temperature and preferably below 0° C.

BACKGROUND OF THE INVENTION

There is a widespread need for many types of liquid to be supplied, or dispensed, at sub-ambient temperature. Much energy and expense is incurred in providing chilled drinks, such as by adding pre-formed ice or by chilling the bottle containing the drink. Such methods have significant disadvantages: ice tends to melt and so dilute the drink, and chilling the entire bottle is both time-consuming and inefficient.

BRIEF SUMMARY OF THE INVENTION

Accordingly, the present invention is predicated on the use of a cryogen to chill a liquid. The present invention also provides an apparatus for supplying a liquid comprising conduit means for bringing the liquid at or about ambient temperature into indirect thermal contact with a cryogen so as to chill the liquid below ambient temperature.

The term "cryogen" is used herein to denote those gases and gas mixtures which at ambient temperature and pressure are normally in gaseous form—air, nitrogen, oxygen, carbon dioxide and the like—but which are used in the liquid or solid state, as well as azeotropic mixtures such as solid carbon dioxide and acetone. Such substances are, in use, all at a temperature substantially below 0° C. (boiling point, at ambient pressure, of carbon dioxide being −78° C. and nitrogen −194.3° C.) and thus have considerable capacity to chill an equivalent volume of a liquid to sub-ambient temperature very quickly. In fact, the cooling rate achievable using such cold substances is so great that care has to be taken not to over-chill, or even freeze, the liquid. Thus, in the present invention, a degree of thermal separation between the cryogen and the liquid to be cooled is important, so as to prevent over-chilling. In the case of spirits for example (alcoholic drinks containing between about 35% and about 50% alcohol by volume), these are preferably chilled to about −5° C. before drinking; because of their alcohol content, spirits usually remain liquid at these temperatures and when drunk will give the drinker the frisson of frozen pleasure sought without being so cold as to damage the tissues of the mouth.

Preferably at least one conduit in thermal contact with the cryogen is provided each conduit being adapted to allow a throughflow of the liquid, or beverage, to be supplied, the liquid being in direct thermal contact with the conduit(s). This enables the high cooling rate of the cryogen to be used but enables over-chilling to be avoided.

Means may be provided to restrict the throughflow of liquid, so as to prolong the indirect thermal contact between liquid and cryogen, so as accurately to control the chilling of the liquid, according to its specific heat capacity, for example. This may be combined with means to supply a metered dose, or shot, of liquid for chilling, as is the norm for the commercial dispensing of spirits, for example.

The conduit(s) may be formed of a thermally-conductive material, and in relatively poor thermal contact with the cryogen. This allows rapid heat transfer between conduit(s) and liquid so as rapidly to chill the liquid by the desired amount without over-chilling, followed by the somewhat slower cooling of the conduit(s) through heat transfer with the cryogen. Clearly a cycle comprising the successive chilling of an amount of liquid, the removal of said liquid from the conduit(s) and the cooling of the conduit(s) to cryogenic temperature is envisaged, a cycle suited to the dispensing of shots of spirits.

The conduit(s) is/are preferably in indirect thermal contact with the cryogen. This permits a preferred arrangement whereby the cryogen is contained within a vessel, the or each conduit being disposed within a channel passing through the vessel and in use being disposed so as to pass through the cryogen. Those skilled in the art will begin to comprehend how such an arrangement will complement the usual "optics" used for dispensing some alcoholic beverages; as a shot of spirits is supplied to a channel, its throughflow is restricted for long enough for the cold channel to chill the spirit to about −5° C. (the specific heats of the channel and spirit resulting in this net temperature—which of course can be varied if seen as appropriate) whilst the heat transfer rate with the surrounding cryogen is insufficient to materially affect this. The shot of spirits then flows out of the channel (typically under gravity) at the desired temperature and the channel then gradually cools to cryogenic temperature so that a further measure of spirits can be chilled. For a typical shot of spirits to be cooled from ambient temperature to −5° C. requires about 1 kCal (4.186 kJ), so a channel of a thermally-conductive material such as plated copper, with silver or gold having a mass of about 0.12 kg would be required. In terms of heat flow, the spirits should flow through the channel in about 5 seconds and the time for the channel to recool would be about 30–40 seconds. This rate of recooling can be controlled by providing a preferential path for heat transfer of known thermal conductivity between the channel and the cryogen; a typical arrangement may comprise the thermally-conductive channel in direct thermal contact with a surrounding layer of known (relatively poor) thermal conductivity of particular area, which layer is in turn in direct thermal contact with either the cryogen itself or the surrounding walls of the vessel or bath containing the cryogen.

Those familiar with the characteristics of cryogens will realise that there are several features which lend themselves to embodiments which will be particularly advantageous in the milieu of commercial spirit dispensing (in bars). Each time that a channel is recooled there will be a corresponding burst of rapid cryogen vaporisation. This will usually result in a puff of fog which, using suitable lighting, could enhance the aesthetic appeal of the spirit chiller. Similarly, the boiling of the cryogen could present an aesthetic attraction in itself, if the cryogen container were transparent and suitably lit, and/or the cryogen itself tinted or coloured.

In practical embodiments of spirit chilling apparatus in accordance with the invention. a single cryogen-containing vessel could have a plurality of channels passing through it, each channel being for the throughflow of a different spirit, so preventing mixing of different spirits prior to discharge from the chiller, and enhancing hygiene. Alternatively, a number of channels may be dedicated to a particular spirit, thus maximising the area of thermal contact between channel and spirit for maximised chilling rate and corresponding boiling of cryogen for eye appeal.

For ease of cleaning the or each channel is suitably disposed within the vessel, and/or the vessel is advantageously configured such that, on tilting the vessel away from its usual in use position, the channel(s) is/are disposed above the surface of the liquid cryogen within the vessel. It will also be understood that means are preferably provided for preventing any convective flow of ambient air into the channel(s), since this would lend to the formation of frost and, ultimately, blockage thereof.

BRIEF DESCRIPTION OF THE DRAWINGS

The invention will now be described by way of example and with reference to the accompanying drawings in which.

DETAILED DESCRIPTION

Figure 1:
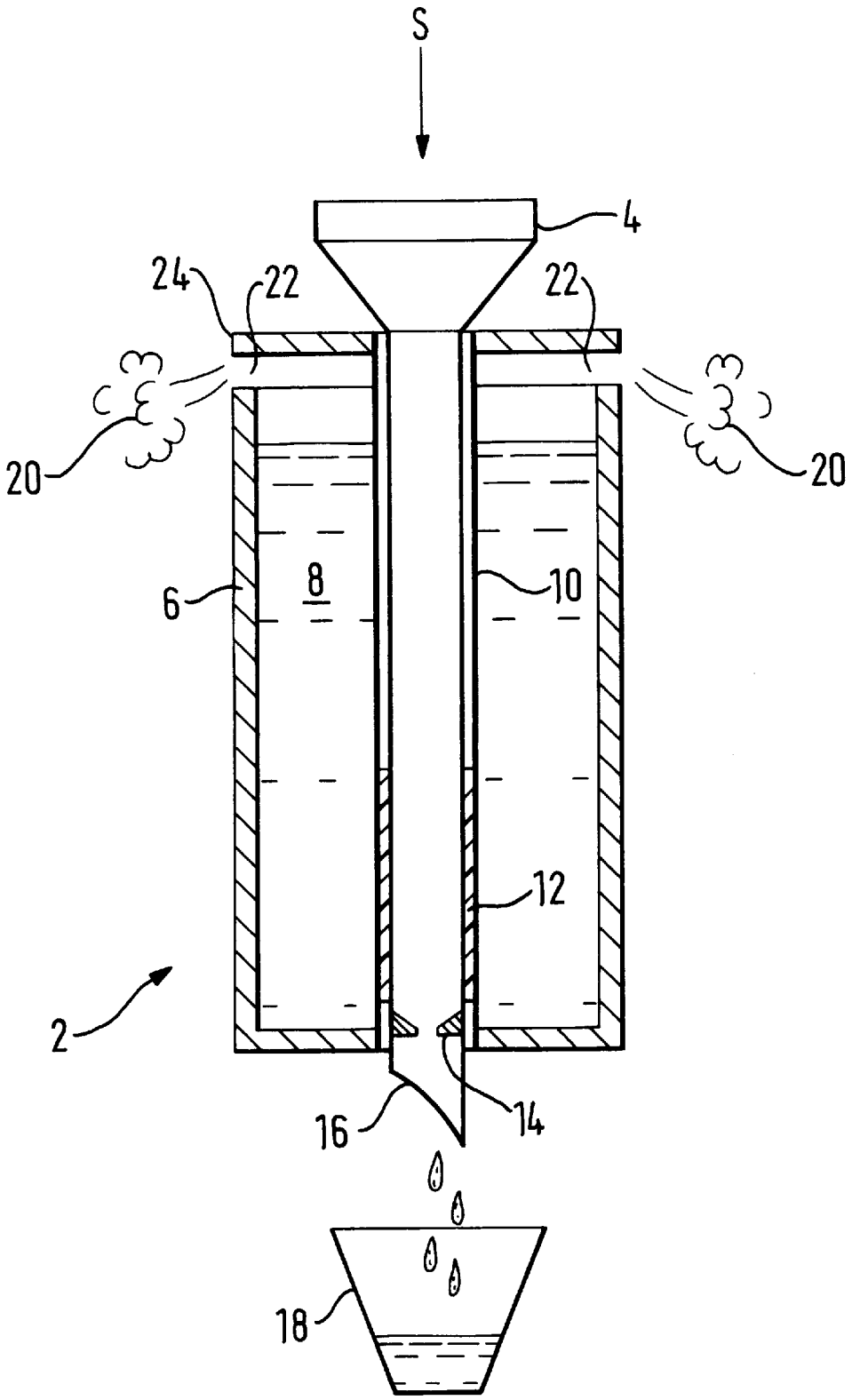
FIG. 1 is a schematic cross-sectional view of a first embodiment of spirit chilling apparatus in accordance with the invention.

In the spirit chilling apparatus 2 illustrated in FIG. 1, a measured shot of spirit is supplied in the direction of arrow S into a channel or tube 4. Tube 4 passes through an insulated vessel or bath 6 containing a cryogenic liquid 8, the tube 4 being concentric within an uninsulated tube 10 which is in direct thermal contact with the cryogen 8 and is also integral with vessel 6. Tube 4 is formed of relatively high thermal conductivity material but which is in relatively poor thermal contact with the liquid cryogen 8, there being a PTFE-coated contact area 12 between inner tube 4 and outer tube 10.

In the operation of spirit chiller 2, a measured shot of spirits is introduced into tube 4 and flow restrictor 14 permits only a limited flow of spirits out of tube 4 via outlet 16. Whilst the shot of spirits is retained within tube 4 there is rapid heat transfer between spirits and tube 4, such that both reach a net temperature of about −5° C. before the chilled dose of spirits is dispensed into container, or glass, 18.

Tube 4 is subsequently cooled back to the temperature of liquid cryogen 8 relatively slowly by heat transfer with contact area 12. The arrangement is such that the spirits flow through tube 4 and emerge chilled to −5° C. in about 5 seconds, and the time for the tube 4 to be cooled back down to the temperature of the liquid cryogen 8 is about 30 to 40 seconds.

Each time a shot of spirits is dispensed via chiller 2 a certain amount of the cryogen 8 vaporises or is boiled off, producing a cloud of fog 20 which emerges from gap 22 between the lid 24 of the container and the main part of the vessel 6 in a breathtaking display. Alternatively, valve means (not shown) may be provided for the egress of these clouds 20 of fog. Also not shown are means for supplying liquid cryogen to the vessel 6 in order to maintain a constant level of liquid cryogen therein.

Those skilled in the art will, in combination with the above more general description, immediately appreciate how the illustrated apparatus may be modified in order to combine aesthetic appeal, functional efficiency and ease of maintenance/cleaning. For example, the flow restrictor 14 may also be configured so as to prevent a flow of ambient air into tube 4 via inlet 16, as this would rapidly cause the apparatus to be choked with frost. Similar means could be provided for preventing the ingress of air into the end of tube 4 distant from outlet 16, and apparatus 2 could quite easily be combined with the known optic device for dispensing spirits to provide an integral spirit chiller/dispenser.

Figure 2:
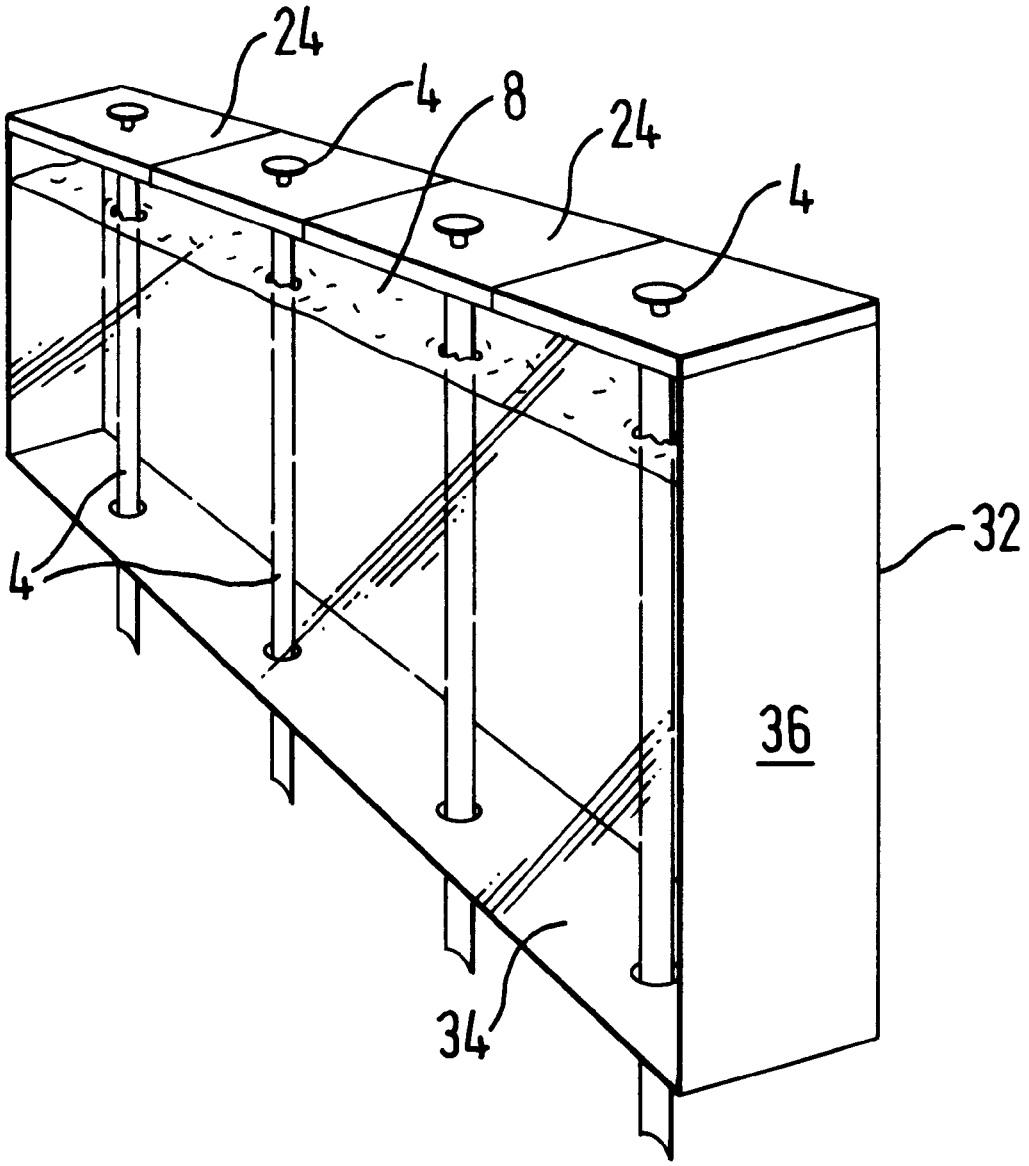
FIG. 2 is a schematic isometric view of several dispensers of FIG. 1 arranged in any array.

FIG. 2 shows an array of several of the chillers 2 of FIG. 1 but disposed in a housing 32, having double or triple insulated glass (or other transparent material) front 34 and rear faces and solid insulated side faces 36. Such an arrangement provides a single housing 32 containing several spirit chilling and dispensing tubes 4 (four are shown, but my number could be provided) but which requires only one supply (not shown) to maintain the cryogen 8 at the optimum level. The transparent faces enable a more impressive visual display - by shining coloured lights through the housing 32, for example.

Figure 3:
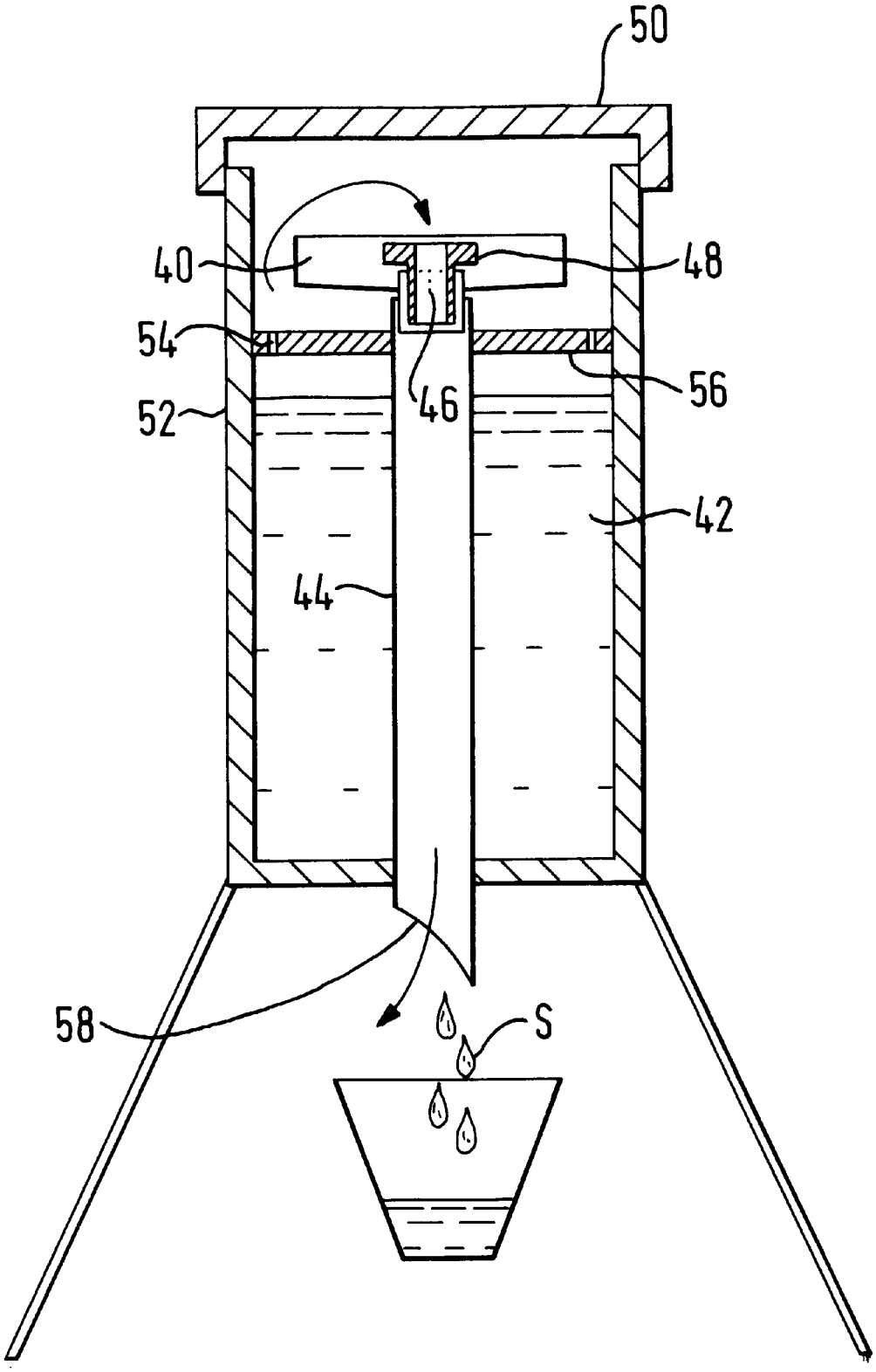
FIG. 3 is a schematic cross-sectional view of a second embodiment of a spirit chilling apparatus in accordance with the invention.

In the embodiment of FIG. 3, the restriction on the spirit flow through the tube 44 is at the top of the tube 44 rather than the bottom, so as to ensure that the spirit is introduced in such a way that it wets the inside surface of the tube 44. This maximises heat transfer between spirit and cryogen 42, and thus also the chilling of the spirit S. This is achieved by introducing the spirit though an arrangement comprising a drink funnel 40 and, a thin slit weir 46 and a hollow plug 48 seated at the top of the tube 44. In the illustrated embodiment, the lid 50 is sealingly fitted to the insulated housing 52 so that evaporated cryogen passes through fill/vent holes 54 in a spray baffle plate 56 and then, in the direction shown by the arrows, through the hollow plug 48, down the tube 44 to exit from its lower end 58. The advantage of this arrangement is that the evaporated cryogen remains in heat exchange relationship with the spirits in the tube 44, thus adding to the chilling effect.

Figure 4:
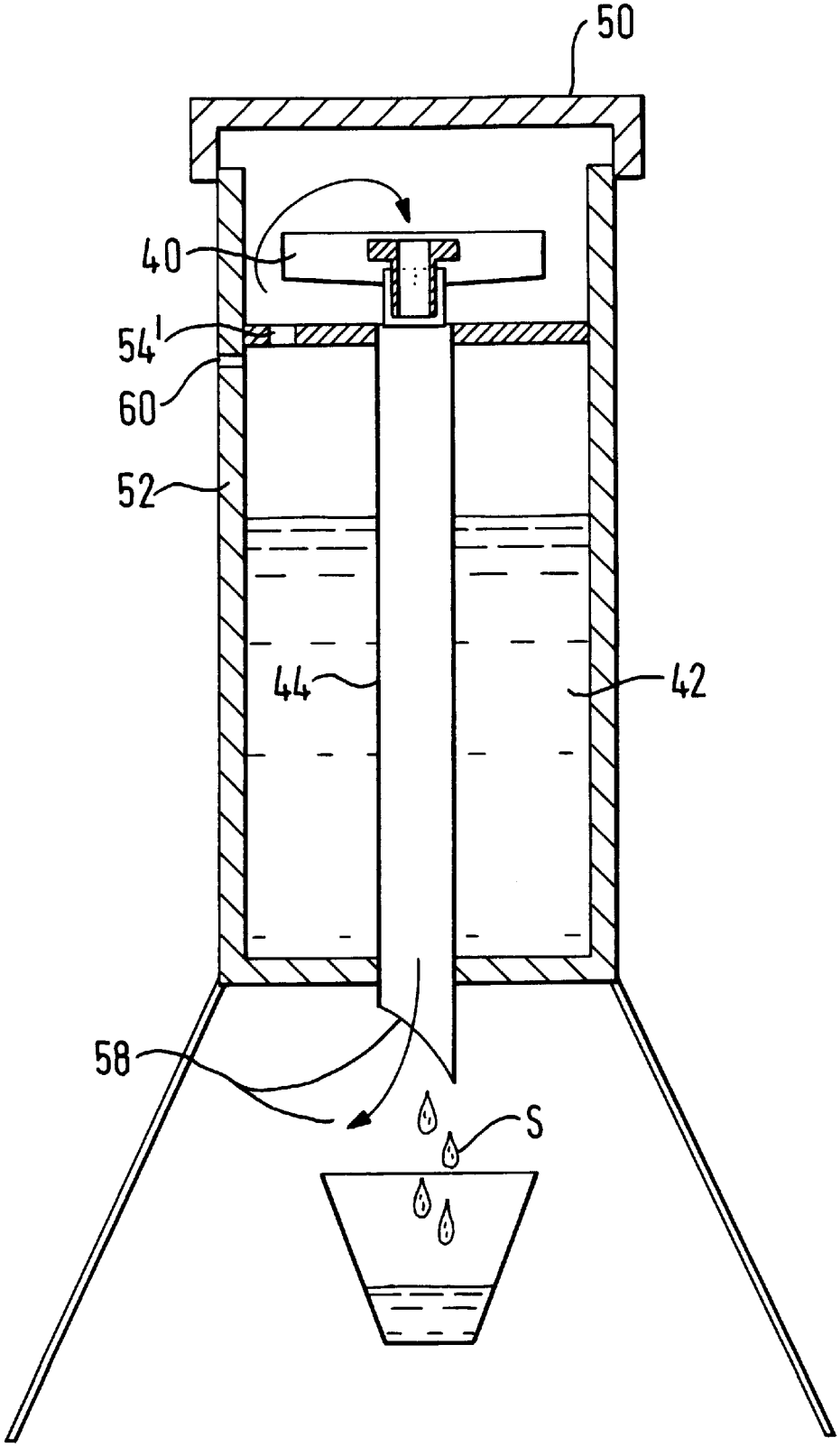
FIG. 4 is a schematic cross-sectional view of a third embodiment of a spirit chilling apparatus in accordance with the invention.

In the embodiment of FIG. 4, like numerals denote similar elements to those shown in FIG. 3. Instead, however, of a plurality of small holes 54 for filling the housing 52 with cryogen and allowing evaporated cryogen to vent there is a single large hole 54'. A complementary gas vent 60 is also provided in the housing 52, to allow a proportion of evaporated cryogen to vent near the top of the housing 52, to enhance the visual effect as a shot of spirits is dispensed.

Those skilled in the art will appreciate that many straightforward modifications may be made to the embodiments illustrated. For example, either of the embodiments of FIGS. 3 and 4 could be arranged in arrays, as in FIG. 2. Moreover, although a liquid cryogen is preferably used, a solid cryogen, such as dry ice ($CO_2$), may be used in place of a liquid cryogen. The production of dry ice in the form of $CO_2$ snow, using a liquid $CO_2$ source and a snow horn is simple, well known in the art, and may be more convenient and/or safer in some applications of this invention than liquid cryogens such as nitrogen, oxygen or acetone, which can present asphyxiation, explosive or environmental hazards, respectively.

Finally, to avoid misapprehension, whenever the words "comprises" or "comprising" are employed herein, in the description, claims or abstract, they are not to be construed as comprehensive or exhaustive; that is to say, the words are always to be read and construed as if preceded by the term "inter alia".

What is claimed is:

1. Apparatus for supplying spirits comprising conduit means for bringing said spirits at or about ambient temperature into indirect thermal contact with a liquid cryogen so as to chill said spirits to a temperature of about −5° C.

2. Apparatus according to claim 1 comprising at least one conduit in thermal contact with the cryogen, the or each conduit being adapted to allow a throughflow of liquid to be supplied.

3. Apparatus according to claim 2 comprising means to restrict the throughflow of liquid, so as to prolong the indirect thermal contact between liquid and cryogen.

4. Apparatus according to claim 2 wherein the or each conduit is formed of a thermally-conductive material and is in relatively poor thermal contact with the cryogen.

5. Apparatus according to claim 2, wherein the or each conduit is in indirect thermal contact with the cryogen.

6. Apparatus according to claim 5 wherein the liquid cryogen is contained within a vessel, the or each conduit being disposed within a channel passing through the vessel and in use being disposed so as to pass through the cryogen.

7. Apparatus according to claim 6 wherein the or each channel is disposed within the vessel, and/or the vessel is configured such that, on tilting the vessel away from its vertical, in use, position, the channel(s) is/are disposed above the surface of a liquid cryogen within the vessel.

8. Apparatus according to claim 7 comprising means for supplying a metered dose of liquid to the conduit means.

9. Apparatus according to claim 8 wherein the liquid is a drink and wherein the apparatus is adapted to chill the liquid to below 0° C.

10. Apparatus according to claim 3 wherein the or each conduit is formed of a thermally-conductive material and is in relatively poor thermal contact with the cryogen.

11. Apparatus according to claim 3 wherein the or each conduit is in indirect thermal contact with the cryogen.

12. Apparatus according to claim 4 wherein the or each conduit is in indirect thermal contact with the cryogen.

13. Apparatus according to claim 1 comprising means for supplying a metered dose of liquid to the conduit means.

14. Apparatus according to claim 1 wherein the liquid is a drink and wherein the apparatus is adapted to chill the liquid to below 0° C.

* * * * *